US005366353A

United States Patent [19]

Hand

[11] Patent Number: 5,366,353

[45] Date of Patent: Nov. 22, 1994

[54] AIR VALVE WITH BLEED FEATURE TO INHIBIT ICING

[76] Inventor: Kent P. Hand, 244-126th Ave. NW., Coon Rapids, Minn. 55448

[21] Appl. No.: 223,936

[22] Filed: Apr. 13, 1994

[51] Int. Cl.[5] ..... F04B 17/00

[52] U.S. Cl. ..... 417/375; 91/305; 137/625.69

[58] Field of Search ..... 137/625.64, 625.69; 251/356; 91/305; 417/375

[56] References Cited

U.S. PATENT DOCUMENTS

| | | | |
|---|---|---|---|
| 760,122 | 5/1904 | Holmberg | 91/305 |
| 2,890,658 | 6/1959 | Hjarpe | 91/305 |
| 2,944,528 | 7/1960 | Phinney | 121/46.5 |
| 3,235,030 | 2/1966 | Lindberg | 181/52 |
| 3,365,022 | 1/1968 | Barber et al. | 181/36 |
| 3,635,125 | 1/1972 | Rosen et al. | 91/55 |
| 4,009,730 | 3/1977 | Starling | 137/625.69 |
| 4,127,011 | 11/1978 | Giles et al. | 62/402 |
| 4,313,468 | 2/1982 | Patel | 137/625.69 |
| 4,461,204 | 7/1984 | Emonet | 91/55 |
| 4,921,408 | 5/1990 | Kvinge et al. | 417/368 |
| 5,247,965 | 9/1993 | Oka et al. | 137/625.69 |

FOREIGN PATENT DOCUMENTS

| | | | |
|---|---|---|---|
| 0146983 | 11/1951 | Sweden | 91/305 |

*Primary Examiner*—Richard A. Bertsch
*Assistant Examiner*—M. Kocharov

[57] ABSTRACT

The air valve on a reciprocating pneumatic pump bleeds air from the pressurized air chamber into the exhaust port through a hole in the valve cup in order to warm the exhaust port area and prevent ice build up in the area. Such construction is also suited for use in spool valves.

4 Claims, 3 Drawing Sheets

AIR VALVE WITH BLEED FEATURE TO INHIBIT ICING

BACKGROUND OF THE INVENTION

Reciprocating pneumatic motors are well known and have been used in a variety of applications. Such motors, when operated continuously in environments having relatively high humidity, are often subject to the buildup of ice in the exhaust passageways. If the ice is allowed to build up enough, the pneumatic motor will cease operation until the ice has a chance to thaw.

A number of attempts have been made to solve this icing issue including those shown in U.S. Pat. Nos. 4,921,408 and 5,277,099 owned by the assignee of the instant invention.

SUMMARY OF THE INVENTION

It is the object of this invention to provide a mechanism which helps prevent icing in the aforementioned situation as well as to provide a solution which is capable of being retrofitted to existing products in the field.

This invention provides a means of utilizing the heat contained in the incoming supply of air to warm critical portions of the exhaust passageways which help minimize the adverse effects of ice build up. For typical slide type valves, an orifice of known dimension is manufactured into the valve cup which allows a metered amount of relatively warm air to pass through the cup and warm the valve plate and exhaust ports. The backside of the cup typically is contained within the valve chamber containing a pressurized supply of warm air. The orifice may be sized differently depending upon the motor conditions in which it will be operated.

In spool type valves that use a hollow spool for exhaust air exit, the same type of orifice can be used through the spool to warm exhaust porting.

On poppet type valves, the orifice can be manufactured into the poppet or poppet mounting device to perform the same purpose.

A BRIEF DESCRIPTION OF THE DRAWINGS

DESCRIPTION OF THE PREFERRED EMBODIMENT

Figure 1:
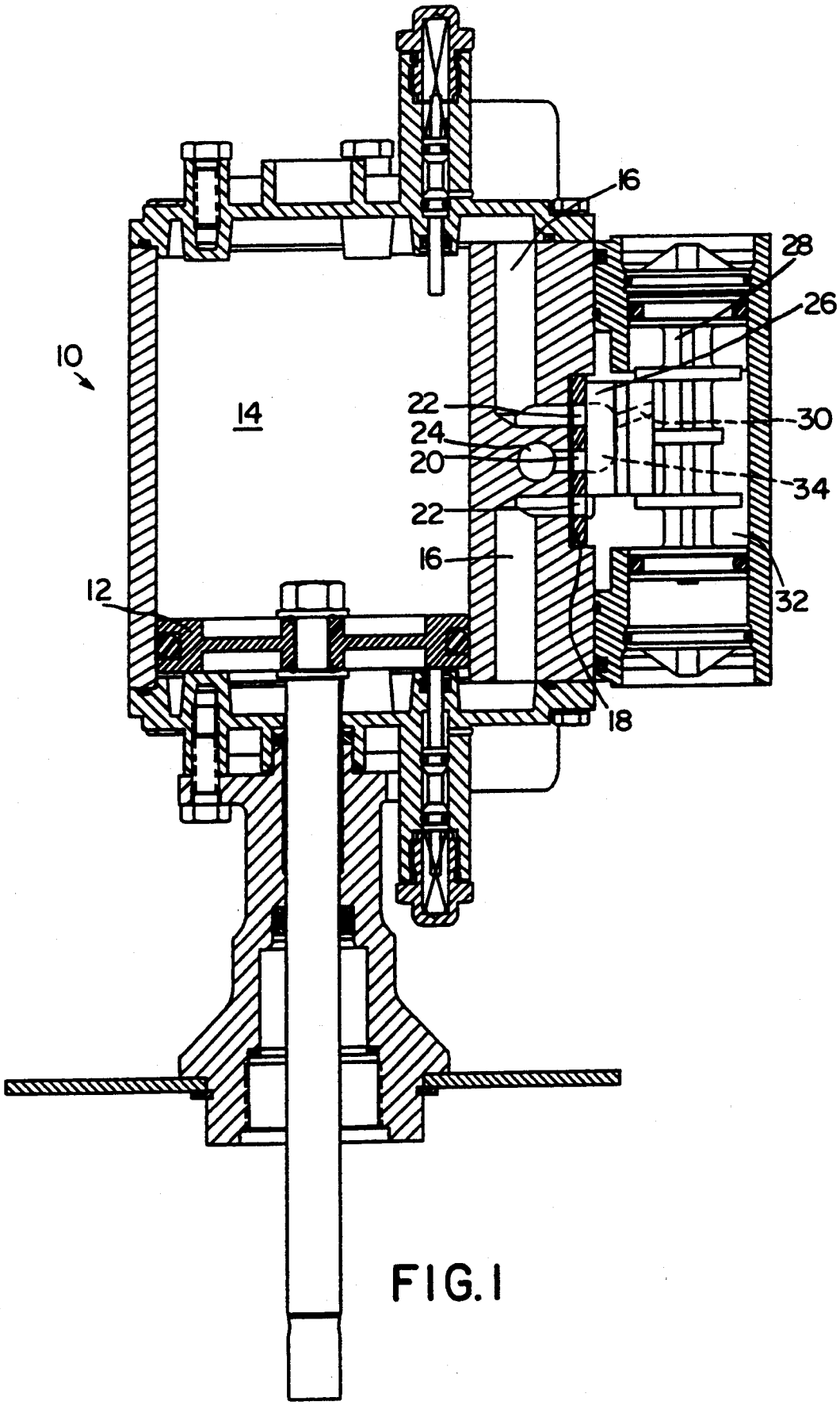
FIG. 1 shows one embodiment of a slide type valve cup.

FIG. 1 shows a cross-sectional view of a pump utilizing the instant invention. A more detailed description of the operation of that pump is set forth in commonly owned U.S. application Ser. No. 08/004,921, filed Mar. 18, 1993, the contents of which are hereby incorporated by reference.

In the pump of the instant invention, generally designated 10, a reciprocating piston 12 has located on one side thereof on air chamber 14 (a similar air chamber not shown exists on the other side of piston 12 when piston 12 is at the other end of its travel.) Two chamber passages 16 serve to connect chambers 14 to valve plate 18. Valve plate 18 has an exhaust orifice 20 and two chamber orifices 22 therein, chamber orifices 22 being connected to passages 16. Exhaust orifice 20 is connected to exhaust port 24. A valve cup 26 is slideably located on top of valve plate 18 and serves to alternately connect exhaust orifice 20 with one or the other of chamber orifices 22. The uncovered chamber orifice 22 (the bottom one is shown on FIG. 1) is open to the pressurized valve chamber 32 which contains compressed air and thus serves to pressurize the air chamber of the motor itself. Spool valve 28 is located in the valve chamber 32. A bleed orifice 30 is drilled in valve cup 26 and serves to connect cup area 34 with valve chamber 32. This allows the warm pressurized air in chamber 32 to bleed into the exhaust port 24, thereby helping serve to warm the valve plate 18 and the exhaust passage 20, thereby preventing the build up of ice.

Figure 2:
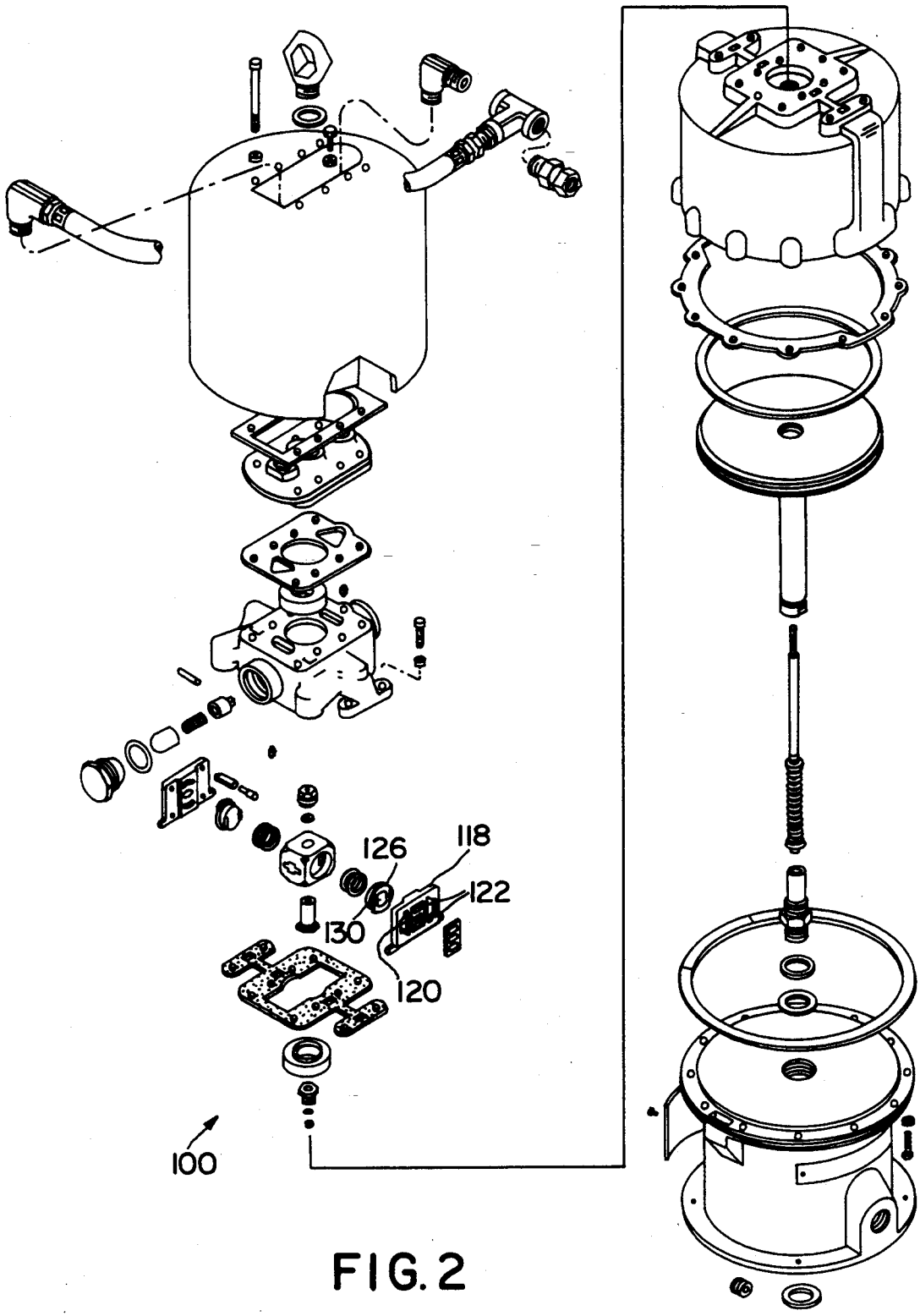
FIG. 2 shows a different embodiment of a slide type valve cup.

FIG. 2 shows an alternate embodiment of the instant invention. This is incorporated into an air operated reciprocating piston pump of the type well known on the industry and sold by the assignee of the instant invention under the trademarks KING or BULLDOG. In this device, generally designated 100, a valve plate 118 has an exhaust orifice 120 and chamber orifices 122. Valve cup 126 slides thereover and has a bleed orifice 130 drilled therein which connects the source of pressurized air with the exhaust port. Operation is the same as previously discussed.

Figure 3:
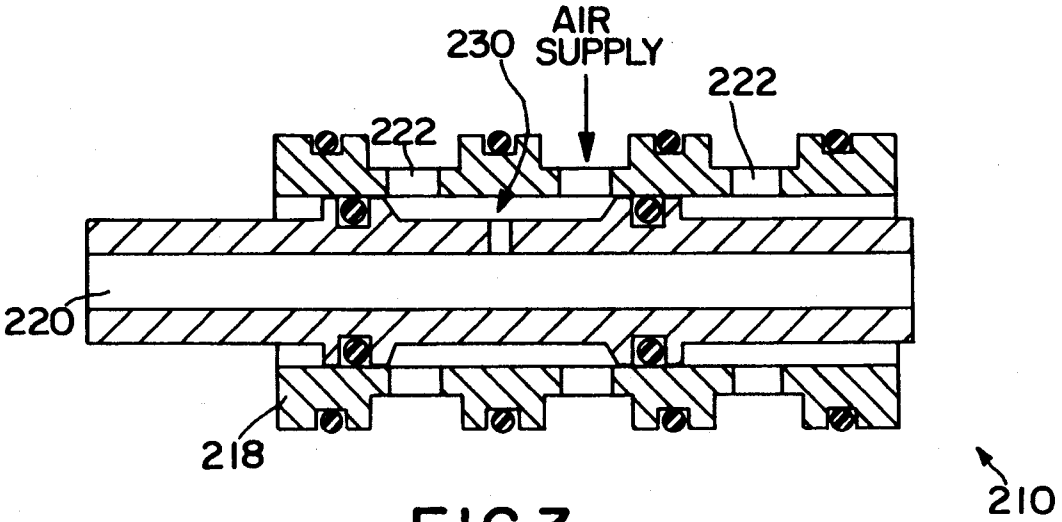
FIG. 3 shows an embodiment of a spool valve utilizing the instant invention.

FIG. 3 shows an alternate embodiment of the instant invention. This is incorporated into a spool valve which may be incorporated into reciprocating pumps of various types well known on the industry. In this device, generally designated 200, a spool housing 218 has an exhaust passage 220 and chamber orifices 222. Valve spool 226 slides in housing 218 and has a bleed orifice 230 drilled therein which connects the source of pressurized air with the exhaust port. Operation is the same as previously discussed.

These and other objects and advantages of the invention will appear more fully from the following description made in conjunction with the accompanying drawings wherein like reference characters refer to the same or similar parts throughout the several views.

It is contemplated that various changes and modifications may be made to the air valve without departing from the spirit and scope of the invention as defined by the following claims.

What is claimed is:

1. In a reciprocating air-operated pump having an air valve chamber filled with pressurized air and wherein a portion of said chamber is bounded by a valve plate having at least one chamber orifice connected to an air motor chamber and an exhaust orifice, connected to an exhaust port, said orifices being selectively connected by a valve cup, the improvement comprising said valve cup having a bleed orifice therein whereby said pressurized air is bled into said exhaust port.

2. The pump of claim 1 wherein said bleed orifice is sized to prevent ice build up in said exhaust during operation.

3. In a reciprocating air-operated pump comprising an air valve chamber filled with pressurized air and an air valve having at least one chamber orifice connected to an air motor chamber and an exhaust orifice, connected to an exhaust port, said orifices being selectively connected by said air valve, the improvement comprising said air valve having a bleed orifice therein whereby said pressurized air is bled into said exhaust port.

4. The pump of claim 3 wherein said bleed orifice is sized to prevent ice build up in said exhaust during operation.

* * * * *